United States Patent [19]

Sugahara et al.

[11] 3,975,207

[45] Aug. 17, 1976

[54] METHOD OF TAKING OUT SCALE FROM POLYMERIZATION REACTOR

[75] Inventors: Mitsuaki Sugahara; Teizo Sato; Sakae Kobayashi; Akira Kanekawa, all of Iwaki, Japan

[73] Assignee: Kureha Kagaku Kogyo Kabushiki Kaisha, Tokyo, Japan

[22] Filed: Oct. 21, 1975

[21] Appl. No.: 624,428

[30] Foreign Application Priority Data

Nov. 27, 1974 Japan ..... 49-135625

[52] U.S. Cl. ..... 134/6; 134/8; 134/38; 134/42

[51] Int. Cl.[2] ..... B08B 7/04

[58] Field of Search ..... 134/6, 8, 22 R, 38, 134/42; 264/39; 15/211

[56] References Cited

UNITED STATES PATENTS

| | | | |
|---|---|---|---|
| 3,619,295 | 11/1971 | Nishizaki et al. | 134/38 X |
| 3,679,477 | 7/1972 | Zimmer | 134/8 |
| 3,764,384 | 10/1973 | Berni | 134/38 X |

*Primary Examiner*—Robert L. Lindsay, Jr.
*Assistant Examiner*—Marc L. Caroff
*Attorney, Agent, or Firm*—Oblon, Fisher, Spivak, McClelland & Maier

[57] ABSTRACT

Scale particles of vinyl polymer which accumulate on the inner surfaces of the polymerization reactor and are peeled therefrom are removed by placing a net into the reactor through an opening in the reactor and entrapping the particles within the strands of the net whereby the particles are removed from the reactor when the net is withdrawn.

5 Claims, 3 Drawing Figures

METHOD OF TAKING OUT SCALE FROM POLYMERIZATION REACTOR

BACKGROUND OF THE INVENTION

1. Field of the Invention

The present invention relates to a method of removing scale which accumulates during the polymerization of vinyl monomers from a polymerization reactor. More particularly, the present invention relates to a method of removing scale which cannot be removed during the convenional method of discharging polymer in the polymerization of vinyl monomers.

2. Description of the Prior Art

When a vinyl monomer such as vinyl halide, for instance, vinyl chloride, vinyl fluoride, vinylidene chloride, vinylidene fluoride, tetrachloroethylene or chlorofluorethylene; or another vinyl monomer such as vinyl acetate, styrene, methylmethacrylate, is polymerized, the resulting polymer adheres to the inner walls of the polymerization reactor and the surfaces of apparatus accessories such as stirrers, buffle plates, and temperature detectors. As the polymerization reaction proceeds, polymer gradully accumulates as a scale on the reactor surfaces. In the conventional method of removing accumulated scale from polymerization reactors, the scale in the reactor is washed out and peeled from the reactor surfaces by spraying pressurized water onto the deposited scale. Some of the scale which is loosened by this procedure is not discharged through the outlet nozzle of the reactor, but instead accumulates in the bottom of the reactor. In order to remove the scale which remains, a person must go into the reactor and remove the scale. This operation is somewhat dangerous and it is disadvantageous from a workability standpoint.

SUMMARY OF THE INVENTION

Accordingly, one object of the present invention is to provide a method of removing scale which accumulates on the reactor surfaces during the polymerization of vinyl monomer effectively from the polymerization reactor without having a person enter the reactor.

Another object of the invention is to provide a method of removing the scale which accumulates in the reactor during the polymerization of vinyl monomers and which is not discharged from the outlet nozzle of the polymerization reactor.

Briefly, these objects and other objects of the present invention as hereinafter will become readily apparent can be attained in a process for removing vinyl polymer scale which accumulates on the inner surfaces of the polymerization reactor by placing a net within the reactor to entrap particles of the polymer scales which are peeled from the reactor surfaces and then withdrawing the net.

DETAILED DESCRIPTION OF THE PREFERRED EMBODIMENTS

The scale which accumulates in a polymerization reactor during the discharge of a vinylpolymer usually adheres on the inner walls of the reactor and the surfaces of the reactor accessories. When the adhering scale is peeled from the surfaces by spraying pressurized water or scraping the surfaces with a rod, about 10 Kg of scale in mass or flake form falls to the bottom of the reactor. The scale is formed by the accumulating polymer on reactor surfaces and by the polymerization of the accumulated polymer to form the scale in mass or flake form. The particles of scale which are removed from the reactor surfaces are not smooth and have many projections.

Figure 1:
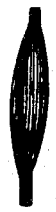
Figure 2:
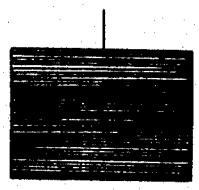
Figure 3:
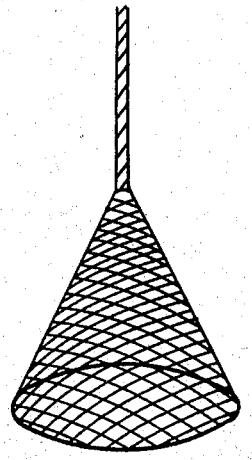

Accordingly, when a net is placed in contact with the broken scale, the projections of the scale are entrapped within the filaments of the net and the scale is thereby caught by the net. The broken scale can then by pulled up by the net and removed from the end opening or manhole of the reactor. The net can be any fiber product in which the broken scale particles having projections fit within the filaments and is not limited to nets having many knots. The net can also be a fiber product having filaments which can be free and substantially in parallel upon hanging which functions by entrapping the broken scale having projections within the stitches of the net. Suitable nets can be plane or bag type nets having many knots. However a fiber product which consists of many parallel filaments which are bound at both ends as shown FIG. 1 can be used. Alternatively, a fiber product consisting of many parallel filaments wherein the filaments are held in the configuration of a reed screen as shown in FIG. 2 can be also used. The optimum form of the net is a net bag having an opening supported with a wire and a strand or a tube hanging the bottom of the net bag as shown in FIG. 3.

The size of the net is not limited by the size of the reactor, but it is limited by the size of the manhole through which the net should be inserted and removed after the scale has been entrapped. The stitch length is not limited by the size of the broken scales as it relates to the fitting of the seals in the stitches. The stitches of the net can be larger than the size of the particles of the broken scale since the broken scale particles stick between the filaments of the stitches.

It is preferable to use the hanging type of net bag which has an opening diameter of about 30–50 cm. When the net contains knots within the strands, the stitch length should preferably be a maximum of about 5 mm to 20 cm, especially about 5 cm to 10 cm. If the stitch length is too long, the broken scale particles which fit within the stitches sometimes slip from the net when it is pulled from the reactor. If the stitch length is too short, it is difficult to remove the broken scale which is entrapped within the net strands after the net is removed from the reactor. If the reed screen type of net is used, the gaps between the strands or filaments of the net are usually less than 5 cm or else there are no gaps at all. The size of the gaps is also a function of the diameter and hardness of the net strands.

The strands of the net can be yarns made of a natural fiber such as hemp, synthetic fiber or the like. It is preferable to use a synthetic fiber which has a high tensile strength and friction resistance such as nylon or polyvinylidene fluoride. The diameter of the filaments is preferably in a range of 0.1–2 mm.

When the scale which has fallen to the bottom of the reactor is to be removed, the net is dropped into the reactor through an opening (manhole) at the top, and the net is allowed to cover the broken scale in the bottom. The broken scale particles are entrapped within the net strands and then the net is slowly pulled from the reactor.

The broken scale particles which have a weight of about 5 g to 10 Kg can be removed by the present method depending upon the type of net used. Furthermore, the broken scale can be easily removed from the net after it is removed from the reactor. In accordance with the method of the invention, the scale which accumulates in the reactor can be easily removed by a device manipulated from the outside of the reactor. Consequently, it is unnecessary to have an operator enter the reactor to remove broken scale particles in the bottom of the reactor.

The withdrawal of the net from the reactor after the broken scale particles have been entrapped within the filaments can be conducted by hand, by a machine or by a remote control operation.

Having generally described this invention, a further understanding can be obtained by reference to certain specific examples which are provided herein for purposes of illustration only and are not intended to be limiting unless otherwise specified

EXAMPLE

In a 16 $m^3$ polymerization reactor equipped with a glass lining inner wall, vinyl chloride was suspension polymerized using a partially hydrolyzed polyvinyl alcohol as the suspension agent and lauroyl peroxide as the polymerization initiator. After the polymerization, the reaction mixture was discharged from an outlet nozzle having a diameter of 10 cm at the bottom of the reactor, and the inner walls of the reactor were washed with a spray of pressurized water. A large amount of scale had fallen to the bottom of the reactor.

A net of polyvinylidene fluoride fibre having strands of a diameter of 0.3 mm with a stitch length of 4.5 cm was used to prepare a bag having an opening diameter of 30 cm and a length of 70 cm. The opening of the bag was held open by a wire. The bottom of the net bag was supported with a rod so as to face the opening downwardly and the net bag was placed into the reactor through the opening (manhole) in the end of the reactor. In the reactor, the net bag was contacted sufficiently with the broken scale particles and the net bag was slowly withdrawn whereby the broken scale particles were entrapped in the stitches of the net. The scale could be removed from the reactor without the scale particles falling from the net as it was withdrawn from the reactor. The weights of the scale particles ranged from a minimum of 7 g to a maximum of 9.6 Kg. A total weight of 10–15 Kg was removed from the reactor in each operation. Heretofore, it has been necessary to remove scale once every 3 or 4 days by placing a person into the reactor. However, in accordance with the method of the invention, the necessity of placing a person within the reactor to remove polymer scale is greatly reduced. With the use of the present procedure it is only necessary to have an operator observe the inner portions of the reactor once every 3 months.

Having now fully described the invention, it will be apparent to one of ordinary skill in the art that many changes and modifications can be made thereto without departing from the spirit or scope of the invention as set forth herein.

What is claimed as new and intended to be covered by letters patent is:

1. In a method for removing scale which forms and accumulates during the polymerization of a vinyl monomer on the inner surfaces of the polymerization reactor and which is not removed when the contents of the reactor are discharged, wherein the scale is dislodged from the said surfaces by peeling the improvement which comprises: entrapping the scale particles which have been peeled from said surfaces by a net composed of fibrous strands which is placed into the reactor and permitted to come in contact with said particles.

2. The method of claim 1, where in the net is a fiber product which when freely hung in said reactor has its fibrous strands in an essentially parallel relationship whereupon when said net is permitted to come in contact with said particles the particles are entrapped within the strands of the net.

3. The method of claim 1 wherein the net is a net bag having an open end supported open by a wire and an opposite bottom end by which said net is hung by a strand.

4. The method of claim 1, wherein the scale is broken into particles having sizes ranging from 5 g to 10 Kg and the particles of the scale are entrapped within the strands of the net.

5. The method of claim 1, wherein the net contains stitches having a stitch length in a range of 5 mm to 20 cm.

* * * * *